US012310521B2

(12) United States Patent
Roberson

(10) Patent No.: US 12,310,521 B2
(45) Date of Patent: May 27, 2025

(54) REVERSIBLE BABY ACTIVITY BLANKET TO TODDLER PILLOWCASE

(71) Applicant: Wendy Noelle Roberson, Sacramento, CA (US)

(72) Inventor: Wendy Noelle Roberson, Sacramento, CA (US)

( * ) Notice: Subject to any disclaimer, the term of this patent is extended or adjusted under 35 U.S.C. 154(b) by 385 days.

(21) Appl. No.: 18/147,319

(22) Filed: Dec. 28, 2022

(65) Prior Publication Data

US 2023/0271096 A1 Aug. 31, 2023

Related U.S. Application Data

(60) Provisional application No. 63/372,125, filed on Feb. 17, 2022.

(51) Int. Cl.
*A47G 9/02* (2006.01)
*A47D 5/00* (2006.01)

(52) U.S. Cl.
CPC ..... *A47G 9/0223* (2013.01); *A47G 9/0253* (2013.01); *A47D 5/006* (2013.01)

(58) Field of Classification Search
CPC ..... A47G 9/02; A47G 9/0223; A47G 9/0253; A47G 9/062; A47D 5/006; A47D 15/003
See application file for complete search history.

(56) References Cited

U.S. PATENT DOCUMENTS 1,775,061 A * 9/1930 Bertha ..... A47G 9/0253 5/490
2,078,022 A * 4/1937 Roemer ..... A63F 9/088 5/655
D397,902 S * 9/1998 Knorrek ..... 5/639
6,640,362 B1 * 11/2003 Kimball ..... A47G 9/0223 128/854
9,833,087 B1 * 12/2017 Richardson ..... A47G 9/0253
2007/0243784 A1 * 10/2007 Shearrow ..... G09F 15/00 442/320
2010/0125298 A1 * 5/2010 Whitney ..... A47G 9/0223 446/268
2012/0020586 A1 * 1/2012 Gilbert ..... A47G 27/0243 383/4
2012/0073048 A1 * 3/2012 Ballard ..... A47G 9/062 5/485
2016/0220047 A1 * 8/2016 Stang ..... A47G 9/0253
2017/0079338 A1 * 3/2017 Montanari ..... A41B 13/06
2022/0039569 A1 * 2/2022 Smith ..... A47G 9/0253
2024/0016320 A1 * 1/2024 Hedaya ..... A47G 9/0207

* cited by examiner

*Primary Examiner* — Eric J Kurilla

(57) ABSTRACT

A reversable baby activity blanket that turns into a toddler pillowcase that provides entertainment and comfort and includes two detachable pillowcases with zippers, having the inner, reversible pillowcase with fastening material loops on three of the four corners, to securely hold baby sensory items (pacifiers, lightweight toys and blankets, teethers, soft books, small stuffed animals). When reversed and zipped shut, it offers a clean environment for said baby sensory items to be stored. A removably attached polyester tether snaps on to the fourth corner of the inner pillowcase to securely hold a Velcro bracelet or scrunchie to fit baby's wrist and can also be worn separately to carry said items. The outer pillowcase includes a snap to securely hold a fleece cloth, which when infused with mother's scent, offers a sense of security for baby. When age appropriate, the detachable outer pillowcase can be used with a toddler-sized pillow.

7 Claims, 2 Drawing Sheets

REVERSIBLE BABY ACTIVITY BLANKET TO TODDLER PILLOWCASE

CROSS REFERENCE PROVISIONAL PATENT

U.S. 63/372,125 Granted Feb. 28, 2022

1. BACKGROUND

Baby activity blankets offer a comfortable and safe environment for a baby to play. They provide convenient entertainment that can be transported to various locations and placed on a floor area for the baby to play on. Babies can lie on and roll over on these blankets. Sensory toys, pacifiers, and other stimulating accessories are attached to the blankets for additional entertainment. Some activity blankets, mats and gyms promote the use of different motor skills such as reaching, hand-eye coordination, and grasping. Alternatively, others provide a smooth, soft textured material such as satin, for baby to suckle and grasp for a sense of security and nurturing.

Although these conventional activity blankets provide physical, sensory, and cognitive development in a baby, they can be inconvenient and dirty too easily for a parent to tote on errands and when traveling. They may require having to find appropriate-sized floor space to lay the blanket on. Also, the baby must sit or lie on it in order to play with the toys. When the baby outgrows the toys available on the activity blanket, there is no further use for it. Additionally, the world we live in today is full of viruses and germs that can be potentially harmful or lethal to babies. It is necessary to provide the cleanest environment for the baby to learn and grow. Therefore, there is a need for a more lightweight, on-the-go, washable activity blanket that a baby can carry from place to place without chance of dropping his toys on the dirty ground; with the option of further uses in his years to come.

2. SUMMARY OF THE INVENTION

The present invention provides a toddler-sized pillowcase with a second toddler-sized pillowcase that snaps onto the inside. They are both made of smooth, satin material and very lightweight. Similar to the above-mentioned conventional activity blankets, it can be laid on a soft surface for a small baby to lay on and play with the attached toys. In addition to the conventional features, the invention can be hand-held by the parent or baby while enjoying its features; not requiring a surface to lay it flat onto. The invention offers an ideal, unique way to keep toys and baby items clean for them to play with while traveling in compact spaces, such as on an airplane, bus, train, or vehicle.

The present invention has a distinct feature to ensure that the baby won't drop the activity blanket onto an unclean floor. This is a soft, short, 5" tether that's connected to either 1) a Velcro bracelet rattle or 2) a soft elastic baby-sized scrunchie for baby to wear while playing with and/or carrying the activity blanket. If baby loses grip of the blanket, the lightweight tether offers the extra security of it not falling onto the floor or seat. This keeps baby happy so they can continue to play with their clean activity blanket. An option is available to detach this feature if/when no longer needed.

Another unique feature of the present invention is, when the first pillowcase is zipped closed, it offers a clean, easy way for parent (or baby) to transport the second pillowcase. Small baby necessities, such as a diaper and onsie, can also be placed inside the zipped, enclosed, activity blanket when on-the-go. This makes for quick, easy transport to and from the car, busy airport, or train terminal, when needed.

A third feature of the present invention is, when ready to play with the baby activity blanket, the parent unzips the pillowcase and turns it inside out; presenting a soft, satin pillowcase which has a secure, sewn-in satin loop on three of its four corners. These loops have plastic snaps that can hold various sensory toys, pacifiers, and teethers for hours of entertainment for the baby. While playing with the activity blanket, the pillowcase is zipped closed for safety. The fourth corner of the blanket is devoted to the tether that connects with a secure snap for easy carrying. Said tether can also be removed entirely from the blanket with an option to attach toys separately for the baby to carry without dropping. This is an excellent feature that can be used anywhere, including when baby is in a stroller and is learning how to hold toys and pacifiers, without fear of them dropping onto the dirty cement.

When baby is done playing with the activity blanket, it is unzipped and reversed back to the main, outer pillowcase and zipped shut with the toys securely fastened inside. Since the toys will be tucked away in the zipped-up pillowcase, parents can have confidence that the toys are clean for the next playtime. The Velcro bracelet rattle/scrunchie with the tether can be pulled through to the outside pillowcase prior to zipping closed so baby can carry it in confidence, as well.

The pillowcases can be unsnapped and washed separately on the gentle cycle. The lightweight satin is quick to dry. If desired, different toys can then be fastened onto the activity blanket for further development of motor skills and entertainment.

Another feature of the present invention appears on the outside pillowcase. There is a single snap at the bottom left corner that holds a soft-textured square cloth made of coral fleece, washable material. It is removable so that the mother can hold, wear or sleep with the cloth to absorb her scent. Later, when baby is away from its mother, the cloth can offer a soothing security for baby when needed. This cloth can also be snapped to the tether and carried separately from the blanket.

The inclusion of the feature referenced above in the present invention is based on research that suggests that infants are calmed by the scent of their mother. One study was done with a t-shirt embedded with their mother's scent placed nearby. When the babies were placed with someone else who was holding the t-shirt, their heart beats were slower, and they were less anxious. Babies recognize their mother by her smell; and the sense of safety and fear conditioning is related to cues, as this study shows. A mother's smell is very critical for attachment and bonding. This aspect of the invention makes baby separation from their mother less traumatic.

A fifth feature of the present invention is a handle that can be used to hang around the back of the front passenger seat of a vehicle, to provide easy access to the blanket when on-the-go. The handle is made possible by utilizing the tether which is snapped onto the other side of the pillowcase. By using the pillowcase with the handle, all of baby's toys can be kept in one location, preventing them from getting lost under the seat as well as away from the dirty floor of the vehicle. Other essential items, such as a diaper and wipes, can be toted in the pillowcase for easy access, as well.

A sixth feature of the present invention is the outside pillowcase itself. The toddler-sized pillowcase can be used by itself as a security blanket. Other names such as "silky", "binky", and "blankie" have been coined as such. When the baby activity blanket is removed, and the pillowcase is zipped closed, baby can further enjoy carrying and sleeping with their "silky".

The seventh feature of the present invention is available for a toddler ready to sleep with a pillow. Insertion of a toddler-sized pillow into the pillowcase and zipped closed converts into a comfortable resting spot for a small child's head.

The eighth, and final feature of the present invention is the personalized name which is embroidered onto the top right corner of the pillowcase. The baby's name has a heart underneath it with the parents' initials inside. The thread used is glow-in-the-dark, offering an easy guide for baby's hands to locate in the nighttime. It is recommended that the activity blanket be removed prior to leaving the baby to sleep with the pillowcase, or "binky".

3. BRIEF DESCRIPTION OF THE DRAWINGS

Referring now to the drawing in which like reference numbers represent corresponding parts throughout:

Figure 4:
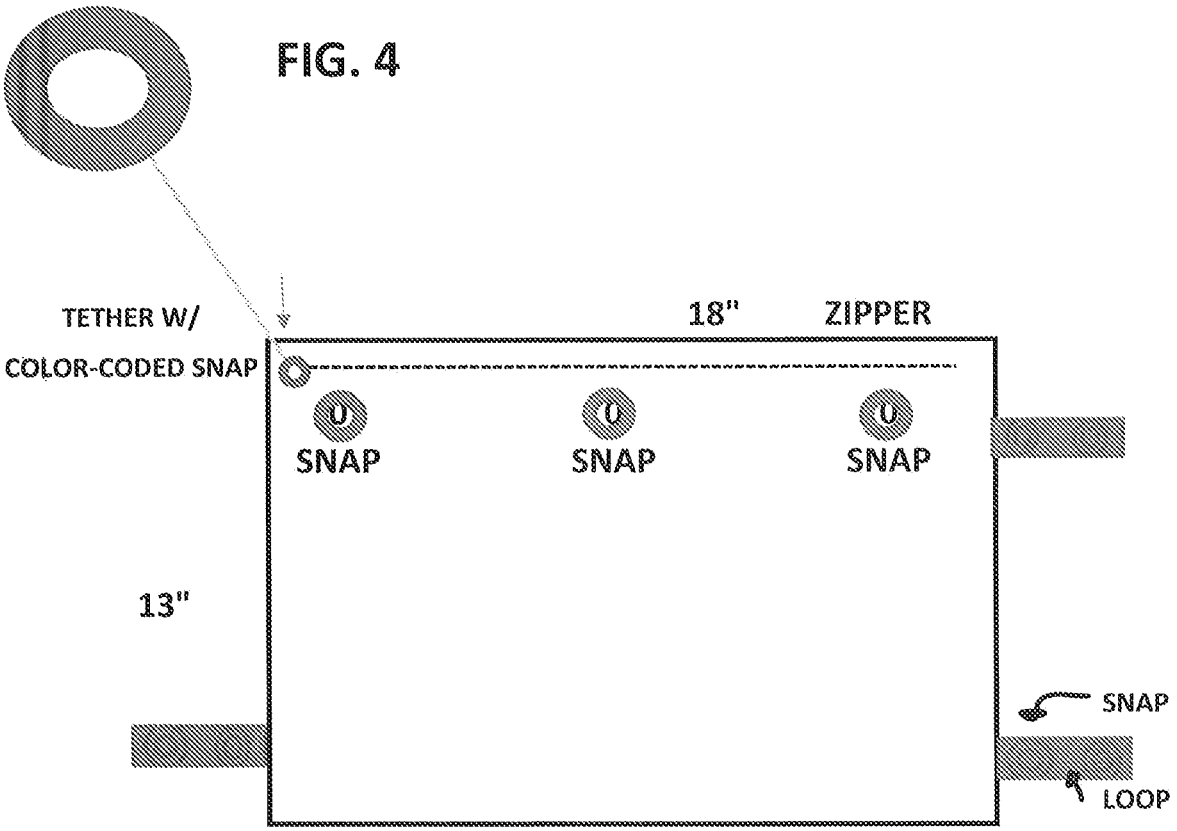

FIG. 4 shows an example of the reversed activity blanket pillowcase. It contains 1) three plastic snaps that are pressed into the satin material firmly with a grommet and fasten to the snaps illustrated in FIG. 1 to hold the two pillowcases together; 2) a zipper; 3) three satin pieces of material that fold into a loop and are securely sewn into the inside of the activity blanket; 4) one plastic snap that is pressed into the satin and folded into a loop to hold baby toys; and 5) a tether with a Velcro bracelet rattle attached to the corner using a separate color-coded plastic snap for easy distinction.

An additional page of colored illustrations labeled A, B, C, D, E, and F, is included to show further details of the present invention. There are various colors of satin that can be used for the pillowcases as well as various toys that can be attached to the activity blanket.

4. DETAILED DESCRIPTION OF THE INVENTION

The reversable baby activity blanket to toddler pillowcase according to the present invention provides safe and clean entertainment and comfort for a baby (e.g., newborn, infant) to play with. In general, the baby activity blanket provides a multi-faceted sensory "kit" for a baby to transition into a toddler. It accommodates an infant all the way into toddler-age, with the use of the reversable pillowcases.

Figure 1:
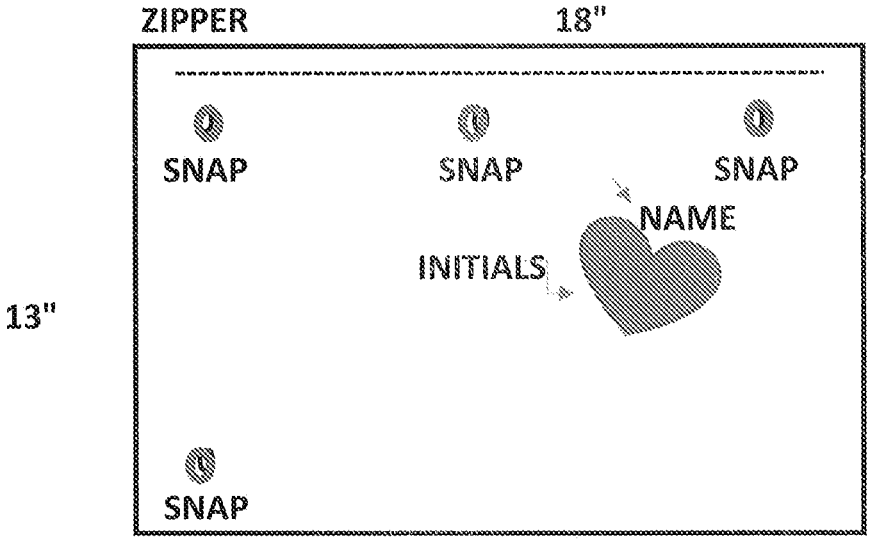
FIG. 1 illustrates the front view of the toddler-sized outside pillowcase. It contains 1) five plastic snaps that are pressed into the satin material firmly with a grommet; 2) a zipper; and 3) personalized embroidered baby name, heart, and parent's initials.

In the illustration shown in FIGS. 1 and 4, the product consists of two 13"×18" satin toddler-sized pillowcases with one turned inside out (shiny side in) and placed inside the other. There are 5 plastic snaps total holding the two pillowcases together just underneath the outside zipper. This includes 2 snaps on the back side of both the inside and outside pillowcases (not illustrated). The inside pillowcase has 12" silk loops sewn into 3 out of 4 of the corners. The loops have snaps for easy removal and changing of baby items. The tether with Velcro bracelet rattle is approximately 15" long and is attach with a color-coded snap at the top corner. The activity pillowcase is zipped closed during use. Unzip when done playing, reverse inside out, and zip outside pillowcase closed once again.

FIG. 1 depicts a personalized, embroidered name of baby in top right corner. Thread is glow-in-the-dark for baby's easy finding during the nighttime. A heart is embroidered under the baby's name with the parent's initials inside. Also illustrated in FIG. 1, In bottom left corner, there is a plastic snap that can attach the soft cloth.

Figure 2:
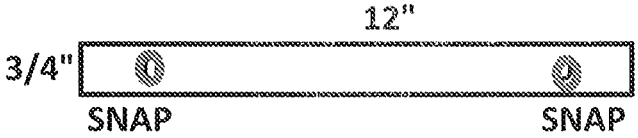
FIG. 2 illustrates the length of satin material used for the loops that are attached to the activity blanket.

FIG. 2 illustrates the length of satin material used for the loops that are attached to the activity blanket. It also shows the approximate measurement of the snap that fastens to hold the toys.

Figure 3:
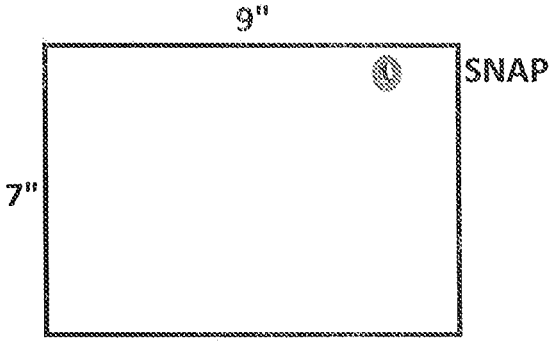
FIG. 3 illustrates the soft coral fleece cloth that can be fastened to the bottom left corner of FIG. 1 or any of the snap loops in FIG. 4.

FIG. 3 shows the soft coral fleece cloth that can be fastened to the bottom left corner of FIG. 1 or any of the snap loops in FIG. 4.

The additional, colored examples of the present invention include the following:

A. The front of the toddler-sized pillowcase with three snaps at the top that fasten to the inside pillowcase, with the soft cloth in green used for mother's scent.

B. The front of the toddler-sized pillowcase in red with embroidered baby's name and parent's initials inside a heart.

C. The inner pillowcase (activity blanket) in yellow with various toys and pacifier attachments using the loops/snaps.

D. An example of the reversable pillowcase in pink being used as a toddler pillow, with pillow inserted. Also, the soft cloth in pink used for mother's scent.

E. Illustrating the two pillowcases from the top, showing the zippers.

F. Illustrating outer pillowcase separately and inner pillowcase (activity blanket) with attachments. Also included in this picture is the soft cloth and the tether with Velcro bracelet rattle.

Note: The fifth feature described in the Summary of the Invention section is utilized by snapping together each side of the color-coded plastic snaps used for the tether feature.

The invention claimed is:

1. A reversible baby activity blanket that turns into a toddler pillowcase comprising:

a rectangular inner pillowcase having two short side ends, a long bottom end, a long top end, and four corners, the inner pillowcase having a fastener across the top long end;

the inner pillowcase having three fastening material loops, one on each of three of the four corners, to securely hold baby sensory items;

a removably attached polyester tether which snaps on to the remaining fourth corner of the inner pillowcase to securely snap a hook-and-loop bracelet or scrunchie to fit a baby's wrist;

a rectangular outer pillowcase having two short side ends, a long bottom end, a long top end, and four corners, the outer pillowcase having a fastener across the top long end;

the removably attached polyester tether having a handle configuration when snapped to each upper end of the outer pillowcase;

the outer pillowcase sized to fit a toddler-sized pillow; and the outer pillowcase having a snap at a bottom left corner of the four corners to securely hold a fleece cloth.

2. The reversible baby activity blanket that turns into a toddler pillowcase of claim 1, wherein said baby sensory items can be interchanged or removed completely from the toddler pillowcase.

3. The reversible baby activity blanket that turns into a toddler pillowcase of claim 1, wherein the removably attached polyester tether, when attached to the hook-and-loop bracelet or scrunchie, will keep said baby sensory items, when attached inside the toddler pillowcase, clean and within reach.

4. The reversible baby activity blanket that turns into a toddler pillowcase of claim 1, wherein the outer pillowcase can be individually used as a baby's security blanket by unsnapping and removing the inner pillowcase.

5. The reversible baby activity blanket that turns into a toddler pillowcase of claim 1, wherein the outer pillowcase can be used separately with a toddler-sized pillow inserted and zipped into said toddler pillowcase.

6. The reversible baby activity blanket that turns into a toddler pillowcase of claim 1, wherein the outer pillowcase is personalized with an embroidered name and heart.

7. The reversible baby activity blanket that turns into a toddler pillowcase of claim 1, wherein the outer pillowcase has a snap to securely hold a small, fleece square-shaped cloth which, when infused with mother's scent, offers a sense of security for baby when away from the parent.

* * * * *